US008186667B2

(12) United States Patent
Hirabayashi et al.

(10) Patent No.: US 8,186,667 B2
(45) Date of Patent: May 29, 2012

(54) CARD TRANSFER SYSTEM AND CARD READER

(75) Inventors: Masahiko Hirabayashi, Nagano (JP); Katsuaki Oguchi, Nagano (JP)

(73) Assignee: Nidec Sankyo Corporation (JP)

( * ) Notice: Subject to any disclaimer, the term of this patent is extended or adjusted under 35 U.S.C. 154(b) by 247 days.

(21) Appl. No.: 12/414,195

(22) Filed: Mar. 30, 2009

(65) Prior Publication Data

US 2010/0244375 A1 Sep. 30, 2010

(51) Int. Cl.
*B65H 5/06* (2006.01)

(52) U.S. Cl. ..... 271/10.13; 271/10.04

(58) Field of Classification Search ..... 271/272, 271/10.04, 10.13
See application file for complete search history.

(56) References Cited

U.S. PATENT DOCUMENTS 4,248,415 A * 2/1981 Steinhilber ..... 271/9.02
5,169,136 A * 12/1992 Yamagata et al. ..... 271/10.13
5,393,044 A * 2/1995 Hagihara et al. ..... 271/10.04
5,884,135 A * 3/1999 Moore ..... 399/361
6,357,738 B1 * 3/2002 Sagesser ..... 271/10.13

FOREIGN PATENT DOCUMENTS

JP 9-91387 A 4/1997
JP 2003-256781 A 9/2003

* cited by examiner

*Primary Examiner* — Kaitlin Joerger
(74) *Attorney, Agent, or Firm* — Cantor Colburn LLP

(57) ABSTRACT

Card transfer system in which a card is transferred may include transfer roller which touches and transfers the card, and rotary shaft on which transfer roller is fixed, and rotating member rotatably supported on rotary shaft, and drive mechanism coupled to rotating member to rotate rotating member, and clutch mechanism which interrupts the power transmission between rotary shaft and rotating member. Rotating member is rotatably supported on rotary shaft by antifriction bearings. Rotary shaft is rotatably supported by multiple bearings and, at the same time, at least bearing arranged closest to rotating member is a plain bearing or sliding bearing.

7 Claims, 3 Drawing Sheets

CARD TRANSFER SYSTEM AND CARD READER

TECHNICAL FIELD

An embodiment relates to a transfer system for use with a card which transfers the card and a card reader equipped with the card transfer system.

BACKGROUND TECHNOLOGY

The card transfer system described in Japanese Unexamined Patent Application Publication No. 2003-256781 comprises a feed roller for feeding a card, a rotary shaft on which the feed roller is fixed, a rotating member rotatably attached to the rotary shaft, and a drive mechanism for rotating the rotating member.

Moreover, this card transfer system comprises a clutch means in which the feed roller fixed to the rotary shaft is isolated from the drive mechanism to rotate freely. This clutch means comprises a pin fixed on the rotary shaft and two engagement protrusions formed on the rotating member. The two engagement protrusions are formed in such a way that they are on the outer face part of the rotating member and spaced from each other in a circular direction.

SUMMARY

As is the case with the card transfer system as described in Japanese Unexamined Patent Application Publication No. 2003-256781, in order to allow the clutch means to operate properly in the card transfer system equipped with a clutch mechanism, the concurrent rotation of the rotary shaft and rotating member must be prevented when the pin and engagement protrusions are not engaged. Nevertheless, the card transfer system as described in Japanese Unexamined Patent Application Publication No. 2003-256781, does not propose a means to prevent the concurrent rotation of the rotary shaft and rotating member.

Therefore, at least an embodiment herein may provide a card transfer system which can prevent the concurrent rotation of the rotary shaft and rotating member when power transmission is cut off by the clutch mechanism. Another embodiment i may provide a card reader equipped with this card transfer system.

Thus, at least an embodiment may comprise a transfer roller which touches and transfers a card, and a rotary shaft on which the transfer roller is fixed, and a rotating member rotatably supported on the rotary shaft, and a drive mechanism coupled to the rotating member to rotate the rotating member, and a clutch mechanism which interrupts the power transmission between the rotary shaft and the rotating member. The rotating member is rotatably supported on the rotary shaft by antifriction bearings. The rotary shaft is rotatably supported by multiple bearings. Among those bearings which support the rotary shaft, at least the bearing arranged closest to the rotating member may be a plain bearing or sliding bearing at least in this embodiment. Other variations are possible.

Thus, in at least an embodiment, a rotating member is rotatably supported on the rotary shaft by antifriction bearings. Moreover, among those bearings which support the rotary shaft, at least the bearing which is arranged closest to the rotating member is a plain bearing or sliding bearing. Since plain bearings or sliding bearings generate higher friction than antifriction bearings, by using an antifriction bearing to support the rotating member and moreover, by using a plain bearing or sliding bearing for the bearing of the rotary shaft arranged closest to the rotating member, the rotating member and the bearing retaining member of the bearings which support the rotary shaft can generate higher rotational resistance than that between the rotating member and the rotary shaft. In this way, when power transmission is cut off between the rotary shaft and the rotating member by the clutch mechanism, if the drive force of the drive mechanism is transmitted to the rotating member, the rotating member rotates around the rotary shaft but the rotary shaft cannot rotate. In other words, when power transmission is cut off between the rotary shaft and the rotating member by the clutch mechanism, the concurrent rotation of the rotary shaft and rotating member can be prevented.

Thus, in at least an embodiment, the clutch mechanism comprises, for example, a first engagement part formed or fixed on the rotary shaft and a second engagement part formed or fixed on the rotating member that can be engaged with the first engagement part.

Thus, in at least an embodiment, the antifriction bearing is preferably arranged at the approximate center position in the axial direction of the rotary shaft in the coupling part between the rotating member and the drive mechanism. In this case, the rotating member is, for example, a pulley, and the drive mechanism has a belt that engages the pulley, and a single antifriction bearing is arranged at the approximate center position in the axial direction of the coupling part, comprising the engagement part of the pulley and the belt. This configuration allows a smaller number of antifriction bearings to bear the drive force transmitted from the drive mechanism to the rotating member. Hence, the number of antifriction bearings can be reduced. For example, as described above, the number of antifriction bearings can be reduced to one.

Thus, in at least an embodiment, fall-preventing protrusions to prevent the fall of the rotational member on the rotary shaft are preferably formed on the rotating member. According to this configuration, in which antifriction bearings are arranged at the approximate center position in the axial direction of the rotary shaft in the coupling part between the rotating member and the drive mechanism; even if the number of antifriction bearings is reduced, the fall of the rotating member on the rotary shaft can be prevented.

Thus, in at least an embodiment the card transfer system can be used for a card reader comprising a frame on which bearings supporting the rotary shaft are attached, and a reproduction/recording means to reproduce data recorded on the card and/or record data onto the card. In this card reader, when power transmission is cut off between the rotary shaft and the rotating member by the clutch mechanism, the concurrent rotation of the rotary shaft and rotating member can be prevented. Moreover, this card reader is provided with a frame, for example, comprising a first frame and a second frame facing each other in approximately in parallel, the rotating member is arranged outside the first frame in the axial direction of the rotary shaft, and the plain bearing or sliding bearing is attached to the first frame.

Thus, as described above, in the card transfer system and card reader of the present invention, when power transmission is cut off between the rotary shaft and the rotating member by the clutch mechanism, the concurrent rotation of the rotary shaft and rotating member can be prevented.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Embodiments of the present invention are described herein with reference to the drawings.

(Schematic Configuration of the Card Reader)

Figure 1:
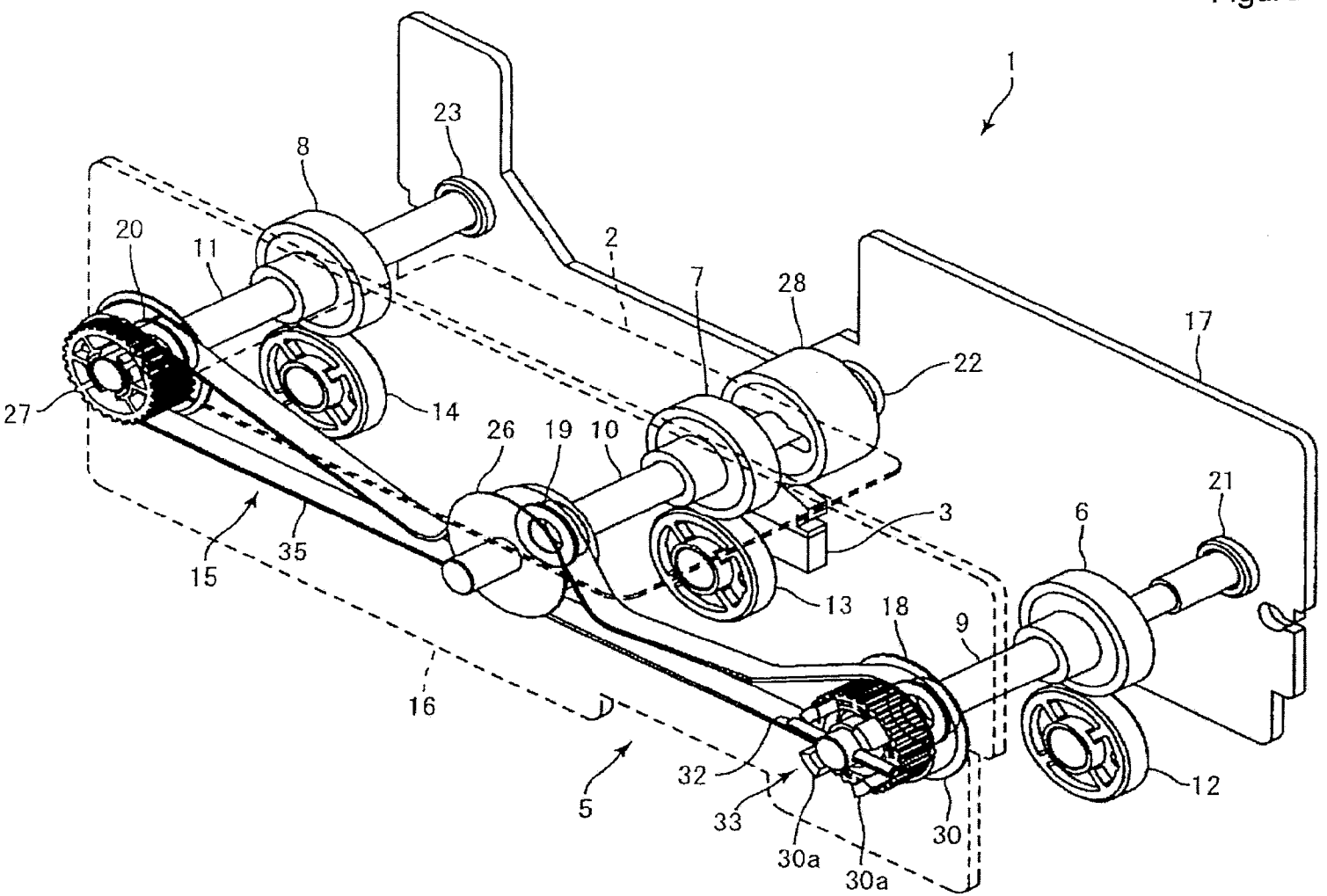
FIG. 1 is a perspective view illustrating a schematic configuration of the card reader of an embodiment.
Figure 2:
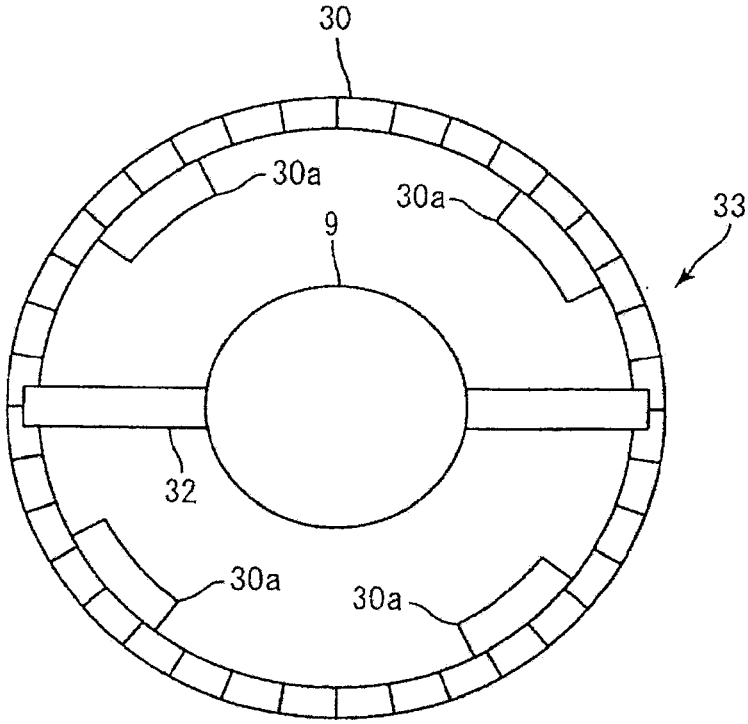
FIG. 2 is a side view illustrating the pulley and its peripheral part of FIG. 1.
Figure 3:
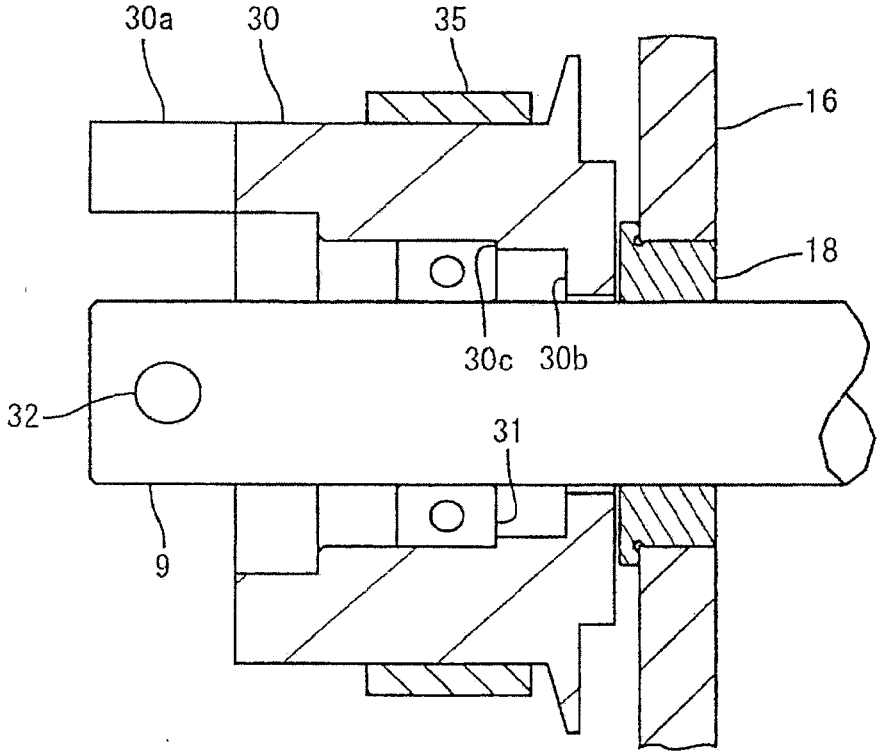
FIG. 3 is a cross-sectional view illustrating the pulley and its peripheral part of FIG. 1.

FIG. 1 is a perspective view illustrating the schematic configuration of card reader 1 of the embodiment of the present invention. FIG. 2 is a side view illustrating pulley 30 and its peripheral parts of FIG. 1. FIG. 3 is a cross-sectional view illustrating pulley 30 and its peripheral parts of FIG. 1.

Card reader 1 of this embodiment is a system in which data, recorded on a for example any magnetic data card 2 (shown in dotted lines), is reproduced and/or data is recorded onto card 2. The present invention does not include the card 2 per se, but the present invention is used with a card 2 which may be supplied from any manufacturer. As illustrated in FIG. 1, this card reader 1 comprises magnetic head 3, which is a data reproducing/recording unit to reproduce magnetic data on card 2 or record magnetic data on card 2, and card transfer system 5 to transport card 2 in card reader 1.

The card 2 of this embodiment is a rectangular vinyl chloride card having a thickness of approximately 0.7~0.8 mm. On the front face of card 2 provided is a magnetic stripe (not illustrated) in which magnetic data is recorded. However, an IC chip may be fixed on the front face of card 2. A communication antenna may also be embedded in card 2, or a printing part which performs heat-sensitive printing may be provided on the front face of card 2. Card 2 may be a polyethylene terephthalate (PET) card having a thickness of approximately 0.18~0.36 mm or a paper card, etc. having a given thickness or any other data card format.

Card transfer system 5 comprises transport roller 6, 7, 8 to transport card 2 by touching the front surface of card 2, and rotary shafts 9, 10, 11 on which transfer rollers 6, 7, 8 are fixed respectively, and pad rollers 12, 13, 14 facing transfer rollers 6, 7, 8 to be energized toward transfer rollers 6, 7, 8 respectively, and drive mechanism 15 to drive transfer rollers 6, 7, 8. Transfer rollers 6, 7, 8 are arranged in the order, for example, from the card insertion slot side to the deep end of card reader 1.

Rotary shafts 9, 10, 11 are supported by first frame 16 and second frame 17 constituting card reader 1. In concrete terms, as illustrated in FIG. 1, first frame 16 and second frame 17 are arranged in approximately parallel to face each other putting a given distance between them. One end of rotary shaft 9, 10, 11 is supported by bearings 18, 19, 20 that are attached to first frame 16 while the other end of rotary shafts 9, 10, 11 is supported by bearings 21, 22, 23 that are attached to second frame 17. All of bearings 18, 19, 20, 21, 22, 23 of this embodiment are plain bearings or sliding bearings made by molding a resin or sintered metal, etc.

Transfer rollers 6, 7, 8 are rubber rollers whose circumferential end has rubber bands fixed thereon. These transfer rollers 6, 7, 8 are fixed at the approximate center position in the shaft direction of rotary shafts 9, 10, 11. Moreover, transfer rollers 6, 7, 8 are arranged at the upper end of the transfer path on which card 2 is transferred. Pad rollers 12, 13, 14 are arranged at the upper end of the transfer path. These pad rollers 12, 13, 14 are energized upward by an energizing means (not illustrated).

At one end of rotary shaft 10 on which transfer roller 7 is fixed, synchronous pulley 26 is fixed, and another synchronous pulley 27 is fixed at one end of rotary shaft 11 on which transfer roller 8 is fixed. Pulleys 26, 27 are arranged the outside of first frame 16 in the shaft direction of rotary shafts 10, 11. Moreover, magnetic head 3 is arranged below rotary shaft 10. Facing roller 28 facing magnetic head 3 is fixed on rotary shaft 10.

One end of rotary shaft 9 on which transfer roller 6 is fixed is rotatably supported by synchronous pulley 30, which is a rotating member. In concrete terms, as illustrated in FIG. 3, pulley 30 is rotatably supported on rotary shaft 9 by a single antifriction bearing 31. Pulley 30 is arranged outside of first frame 16 in the shaft direction of rotary shaft 8.

Furthermore, engagement pin 32 having a fine cylindrical shape is fixed on rotary shaft 9, at the tip beyond the attachment part of pulley 30. In concrete terms, engagement pin 32 is inserted by pressure and fixed to a hole formed at one end of rotary shaft 9, so that both ends of engagement pin 32 protrude to the outside in the diameter direction of rotary shaft 9.

Pulley 30 is made of a resin and molded in an approximate cylindrical shape having an inner circumferential surface on which the outer circle of antifriction bearing 31 is fixed. At one side face of pulley 30 (the left side face in FIG. 3), engagement nails 30*a*, which can be engaged with engagement pin 32, are formed integrally into pulley 30. In concrete terms, as illustrated in FIG. 2, at the outer circumferential end of one of the side faces of pulley 30 and at a given pitch in a circular direction, engagement nails 30*a* protruding in the axial direction of rotary shaft 9 are formed. In this embodiment, four engagement nails 30*a* having an approximately arc shape are formed at a pitch of approximately 90°.

As illustrated in FIG. 2, both ends of engagement pin 32 are arranged between engagement nails 30*a*, so that engagement nails 30*a* and engagement pin 32 together constitute clutch mechanism 33 which interrupts the power transmission between rotary shaft 9 and pulley 30. In this embodiment, engagement pin 32 is the first engagement part fixed on rotary shaft 9, and engagement nails 30*a* are the second engagement parts fixed on pulley 30.

At the other side face end (the right side face in FIG. 3) of pulley 30, fall-preventing protrusion 30*b* is formed to prevent the fall of pulley 30 on rotary shaft 9. In concrete terms, circular fall-preventing protrusion 30*b*, which protrudes from the inner circumferential face of pulley 30 to the inner end of card reader 1 in the diameter direction, is formed on the other side face end of pulley 30. The inner diameter of this fall-preventing protrusion 30*b* is slightly larger than the diameter of rotary shaft 9. In the shaft direction of rotary shaft 9, as illustrated in FIG. 3, fall-preventing protrusion 30*b* is formed at a position away from antifriction bearing 31, and there is a gap between fall-preventing protrusion 30*b* and antifriction bearing 31.

Antifriction bearing 31 is a ball bearing. As illustrated in FIG. 3, antifriction bearing 31 is arranged on the inner circumferential face of pulley 30 in the state in which one edge (the right edge in FIG. 3) of antifriction bearing 31 touches aligning step part 30*c* formed on the inner circumferential surface of pulley 30. In this embodiment, antifriction bearing 31 is arranged at the approximate center position in the axial direction of rotary shaft 9 in the engagement part of belt 35 described later and pulley 30, comprising drive mechanism 15. In other words, antifriction bearing 31 is arranged so that the centers of belt 35 and antifriction bearing 31 about coincide in the axial direction of rotary shaft 9. Furthermore, in this embodiment, the engagement part comprising belt 35 and pulley 30 also constitutes the coupling part of pulley 30 and drive mechanism 15.

Drive mechanism 15 comprises synchronous belt 35 to be put pulleys 26, 27, 30 around and engaged with pulley 26, 27, 30. Further, drive mechanism 15 comprises drive motor (not illustrated) which is the drive source, and a transmission mechanism (not illustrated) which transmits the driving force of the drive motor to rotary shaft 10 or rotary shaft 11. The transmission mechanism is constructed with a pulley or belt. It may also be constructed with multiple gears, or the like.

As the drive motor rotates, power is transmitted from the drive motor to rotary shaft 10 or rotary shaft 11 via the transmission mechanism, rotating belt 35. Moreover, as belt 35 rotates, pulley 30 rotates. In other words, drive mechanism 15 is coupled to pulley 30 to rotate pulley 30.

(Operation of Clutch Mechanism)

FIGS. 4(A)-4(E) is a diagram illustrating the operation of clutch mechanism 33 of FIG. 1.

The operation of clutch mechanism 33 is described herein with reference to FIGS. 4(A)-4(E). However, in the example of clutch mechanism 33 described below, card 2 is inserted to card reader 1 from the front end of the paper plane of FIG. 1, and card 2 is ejected to the front end of FIG. 1.

As card 2 is inserted to card reader 1, a detection mechanism arranged at the card insertion slot of card reader 1 detects the tip of card 2 and starts the drive motor. As the drive motor starts, pulley 30 rotates.

If clutch mechanism 33 is in the state indicated by the solid line in FIG. 4 (A) at the time of the card insertion, until pulley 30 rotates clockwise at a given angle to allow engagement nails 30*a* to touch engagement pin 32, as illustrated in FIG. 4 (B), the power transmitted between rotary shaft 9 and pulley 30 is cut off between the rotary shaft 9 and the rotating member by clutch mechanism 33. Therefore, rotary shaft 9 does not rotate (i.e. transfer roller 6 does not rotate). In other words, after pulley 30 rotates clockwise at a given angle to allow engagement nails 30*a* to touch engagement pin 32, the power of drive mechanism 15 is transmitted from pulley 30 to rotary shaft 9, rotating rotary shaft 9.

Figure 4A:
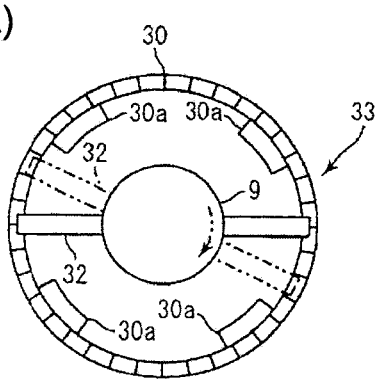
FIGS. 4(A)-4(E) are diagrams illustrating the operation of the clutch mechanism of FIG. 1.
Figure 4B:
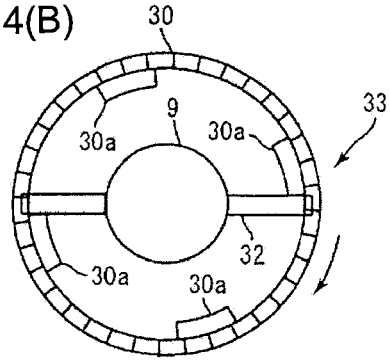
Figure 4C:
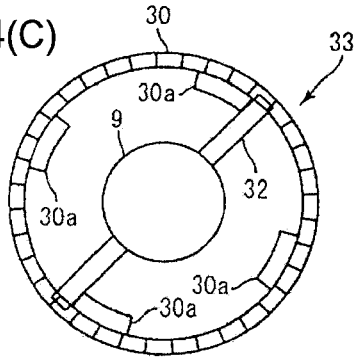
Figure 4D:
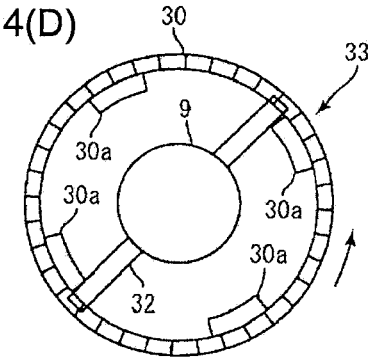

Moreover, if clutch mechanism 33 is in the state in which card 2 is at rest in card reader 1 and has not been ejected, as illustrated in FIG. 4(C), power transmission between rotary shaft 9 and pulley 30 is cut off by clutch mechanism 33 until pulley 30 rotates counterclockwise at a given angle to allow engagement nails 30*a* to touch engagement pin 32, as illustrated in FIG. 4(D). As a result, rotary shaft 9 does not rotate (transfer roller 6 does not rotate). In other words, after pulley 30 rotates counterclockwise at a given angle to allow engagement nails 30*a* to touch engagement pin 32, the power of drive mechanism 15 is transmitted from pulley 30 to rotary shaft 9, rotating rotary shaft 9.

However, if clutch mechanism 33 is in the state in which card 2 has not been inserted to card reader 1 yet, as indicated by the solid line in FIG. 4(A), and card 2 is inserted into card reader 1 by a user, rotary shaft 9 and transfer roller 6 together relatively rotate clockwise with respect pulley 30, as indicated by the double-dot chain line in FIG. 4(A).

Figure 4E:
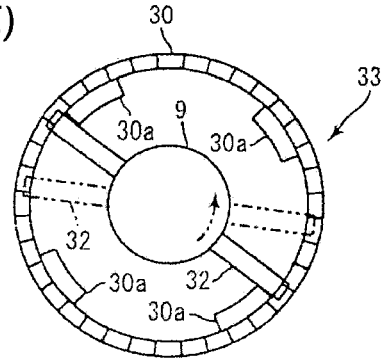

Further, when one end of card 2 is sandwiched between transfer roller 6 and pad roller 12 while the other end of card 2 protrudes from the card insertion slot, and clutch mechanism 33 is in the state as indicated by, for example, the solid line in FIG. 4(E), the pulling of card 2 out of card reader 1 by a user causes rotary shaft 9 and transfer roller 6 together to relatively rotate counterclockwise with respect to pulley 30 as indicated by the double-dot chain line in FIG. 4(E).

Major Effects of this Embodiment

As described above, in this embodiment, pulley 30 is supported on rotary shaft 9 by antifriction bearings 31 so that it can rotate around rotary shaft 9, and one end of rotary shaft 9 is supported by bearing 18, which is a plain bearing or sliding bearing. An example is an oil-impregnated bearing, resin bearing, or oleo-resin bearing, however many types of plain bearings or sliding bearings may be used and the invention is not limited to these specifically listed bearings. In any event, a plain bearing or sliding bearing has a higher operational friction than an anti-friction bearing by definition. Therefore, the rotational resistance between first frame 16 and rotary shaft 9 is greater than that between pulley 30 and rotary shaft 9. Moreover, since the other end of rotary shaft 9 is also supported by bearing 21, which is a plain bearing or a sliding bearing, the rotational resistance is enhanced between rotary shaft 9 and second frame 17. Therefore, in this embodiment, when power transmission is cut off between rotary shaft 9 and pulley 30 by clutch mechanism 33, even if the driving force of drive mechanism 15 is transmitted to pulley 30, pulley 30 rotates around rotary shaft 9 but rotary shaft 9 does not. In other words, the concurrent rotation of rotary shaft 9 and pulley 30 can be prevented when power transmission is cut off by clutch mechanism 33.

In this embodiment, antifriction bearing 31 is arranged at the approximate center position in the axial direction of rotary shaft 9 in the connection part between belt 35 and pulley 30. As a result, a single antifriction bearing 31 can bear the driving force (in concrete terms, the tension of belt 35) which is transmitted from driving mechanism 15 to pulley 30. An example of an antifriction bearing is a ball bearing or a roller bearing; however, many types of anti-friction bearings may be used and the invention is not limited to these specifically listed bearings.

In this embodiment, fall-preventing protrusion 30*b* which prevents the fall of pulley 30 on rotary shaft 9 is formed on pulley 30. Therefore, even if pulley 30 is support on rotary shaft 9 by a single antifriction bearing 31, pulley 30 on rotary shaft 9 will not fall.

However, there is a fear that the formation of fall-preventing protrusion 30*b* on pulley 30 may increase the rotational resistance between pulley 30 and rotary shaft 9. Nevertheless, in this embodiment, in the axial direction of rotary shaft 9, fall-preventing protrusion 30*b* is formed at a point away from antifriction bearing 31 (i.e. in the axial direction of rotary shaft 9, fall-preventing protrusion 30*b* is formed at a point away from the center position in the engagement part between belt 35 and pulley 30). Accordingly, it is not easy for the tension of belt 35 to generate a significant rotational resistance between rotary shaft 9 and fall-preventing protrusion 30*b*. As a result, even if fall-preventing protrusion 30*b* is formed on pulley 30, the concurrent rotation of rotary shaft 9 and pulley 30 can be prevented when power transmission is cut off by clutch mechanism 33.

Alternative Embodiment

The embodiment described above is a preferable mode to carry out the present invention. However, the present invention is not limited to this. A variety of embodiments can be adopted within the scope of the present invention.

In the above embodiment, bearing 21 is a plain bearing or sliding bearing similar to bearing 18. Alternatively, bearing

18 may be an antifriction bearing, for example. In this case too, since bearing 18 arranged near pulley 30 is a plain bearing or sliding bearing, the concurrent rotation of rotary shaft 9 and pulley 30 can be prevented when power transmission is cut off by clutch mechanism 33. Note that bearings 19, 20, 22, 23 may be antifriction bearings.

In the embodiment described above, rotary shaft 9 is supported by bearings 18 and 21 at two places. Alternatively, rotary shaft 9 may be supported by bearings, etc., for example, at three places. In this case, if the bearing arranged closest to pulley 30 is a plain bearing or sliding bearing, the same effect as that of embodiments described above can be obtained.

In the embodiment described above, antifriction bearing 31 is a ball bearing. Alternatively, antifriction bearing 31 may be a roller bearing.

In the embodiment described above, pulley 30, which is a rotating member, is rotatably supported on rotary shaft 9. Alternatively, as a rotating member, a gear, for example, may be rotatably supported on rotary shaft 9. In this case, this gear is rotary supported on rotary shaft 9 by a single antifriction bearing, for example. Moreover, in this case, a single antifriction bearing is also arranged at the center position in the axial direction of rotary shaft 9 in the meshing part between the gear supported on rotary shaft 9 and another gear to be meshed with the gear. Furthermore, in this case, a fall-preventing protrusion that prevents the fall of the gear on rotary shaft 9 is formed on the gear which is supported on rotary shaft 9.

In the embodiment described above, engagement pin 32 is fixed on rotary shaft 9. However, the engagement protrusion, which engages engagement nail 30*a*, may be integrated into rotary shaft 9. Further, in the embodiment described above, engagement nails 30*a* are integrated into pulley 30. However, the engagement members for engaging engagement pin 32 may be members that are separate from pulley 30, and these engagement members may be fixed on pulley 30.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

DESCRIPTION OF SYMBOLS

1 card reader
2 card
3 magnetic head (reproduction and recording means)
5 card transfer system
6 transfer roller
9 rotary shaft
15 driving mechanism
16 first frame (frame)
17 second frame (frame)
18, 21 bearing (plain bearing or sliding bearing)
30 pulley (rotating member)
30*a* engagement nail (second engagement part)
30*b* fall-preventing protrusion
31 antifriction bearing
32 engagement pin (first engagement part)
33 clutch mechanism
35 belt

What is claimed is:

1. A card transfer system for use with a card comprising:
a transfer roller which touches and transfers the card;
a rotary shaft on which said transfer roller is fixed;
a rotating member rotatably supported on said rotary shaft;
a drive mechanism coupled to said rotating member to rotate said rotating member; and
a clutch mechanism which interrupts power transmission between said rotary shaft and said rotating member;
wherein said rotating member is rotatably supported on said rotary shaft by antifriction bearings and said rotary shaft is rotatably supported by multiple bearings, and
among said bearings which support said rotary shaft, at least said bearing arranged closest to said rotating member is a plain bearing or a sliding bearing;
wherein a rotational resistance of the bearing arranged closest to the rotating member is higher than a rotational resistance of the antifriction bearings.

2. A card transfer system as set forth in claim 1 wherein said clutch mechanism comprises a first engagement part formed or fixed on said rotary shaft and a second engagement part formed or fixed on said rotating member that can be engaged with said first engagement part.

3. A card transfer system as set forth in claim 1 wherein said antifriction bearing is arranged at the approximate center position in the axial direction of said rotary shaft in the coupling part between said rotating member and said drive mechanism.

4. A card transfer system as set forth in claim 3 wherein said rotating member is a pulley, and said drive mechanism has a belt that engages said pulley, and a single antifriction bearing is arranged at the approximate center position in the axial direction of said coupling part, comprising said engagement part of said pulley and said belt.

5. A card transfer system as set forth in claim 3 wherein said rotating member comprises a fall-preventing protrusion to prevent the fall of said rotating member on said rotary shaft.

6. A card transfer system as set forth in claim 1 further comprising:
a frame on which bearings supporting said rotary shaft are attached, and
a reproduction/recording device to reproduce data recorded on said card and/or record data onto said card.

7. A card reader as set forth in claim 6 wherein said frame comprises a first frame and a second frame facing each other approximately in parallel, and said rotating member is arranged outside said first frame in the axial direction of said rotary shaft, and said plain bearing or sliding bearing is attached to said first frame.

* * * * *